US006776133B2

(12) United States Patent
Tezuka et al.

(10) Patent No.: US 6,776,133 B2
(45) Date of Patent: Aug. 17, 2004

(54) RECOIL STARTER FOR BACKPACK-TYPE POWER WORKING MACHINE

(75) Inventors: Fuminori Tezuka, Saitama (JP); Haruhiro Sasaki, Tokyo (JP); Kaoru Sakamoto, Tokyo (JP)

(73) Assignee: Kioritz Corporation, Tokyo (JP)

( * ) Notice: Subject to any disclaimer, the term of this patent is extended or adjusted under 35 U.S.C. 154(b) by 22 days.

(21) Appl. No.: 10/253,568

(22) Filed: Sep. 24, 2002

(65) Prior Publication Data

US 2003/0056746 A1 Mar. 27, 2003

(30) Foreign Application Priority Data

Sep. 26, 2001 (JP) ..... 2001-293570

(51) Int. Cl.[7] ..... F02N 3/02
(52) U.S. Cl. ..... 123/185.3
(58) Field of Search ..... 123/185.3

(56) References Cited

U.S. PATENT DOCUMENTS 2,610,657 A 9/1952 Kickhaefer ..... 143/12
2,912,966 A 11/1959 Mitchell
4,658,775 A 4/1987 Greenwood et al. ..... 123/185
5,813,088 A * 9/1998 Wagner et al. ..... 15/327.5

FOREIGN PATENT DOCUMENTS

JP S59-19975 * 2/1984

OTHER PUBLICATIONS

Patent Abstracts of Japan, Publication No. 2001–132591; Date of Publication of Application: 15:05:2001.
Japanese Utility Model Publication H2–48695—Claim.
Japanese Utility Model Unexamined Publication S57–184264—Claim.

* cited by examiner

*Primary Examiner*—Mahmoud Gimie
*Assistant Examiner*—Arnold Castro
(74) *Attorney, Agent, or Firm*—Baker Botts LLP

(57) ABSTRACT

A starter which is capable of having an operator easily perform the starting operation of a backpack-type power working machine while shouldering it, is lighter in weight and cheaper in manufacturing cost, is relatively free from trouble, and can not easily be damaged even if a portion of the starter is caught by the branch of a tree. In this starter, a recoil handle attached to one end portion of the recoil rope is placed remote from the main body of the starter by a predetermined distance and adapted to be supported by a handle-supporting member provided at a specific portion of the working machine; and an extended portion of the recoil rope which is located between the main body and the handle-supporting member is loosely sheathed by a flexible guide pipe, one end of which being fixed, and the other end being made free.

12 Claims, 5 Drawing Sheets

RECOIL STARTER FOR BACKPACK-TYPE POWER WORKING MACHINE

BACKGROUND OF THE INVENTION

1. Field of the Invention

The present invention relates to a recoil starter to be employed for starting an internal combustion engine which is adapted to be mounted on a backpack-type power working machine such as a backpack-type power blower (air blower-type cleaner), backpack-type power sprayer, etc.

2. Description of the Related Art

The recoil starter to be employed for starting an internal combustion engine which is adapted to be mounted on a backpack-type power working machine is generally constructed such that it is provided with a recoil handle (recoil rope) so that the internal combustion engine can be started by pulling the recoil handle against the compression-resisting force of the engine, and that once this recoil handle is released, the recoil rope is automatically wound up to the original state thereof by the effect of recoil-urging means.

When the recoil rope is kept wound up to the original state thereof, i.e. when the engine-starting operation is not performed, the recoil handle is usually kept stayed at the recoil rope outlet port of the main body of the starter. Therefore, it is impossible for the operator to reach the recoil handle under the condition where the working machine is kept shouldered by the operator's back, i.e. it is impossible for the operator to pull the recoil handle and hence to start the internal combustion engine under such a condition as mentioned above. Therefore, if the operator wishes to restart the internal combustion engine after the stop thereof while carrying the working machine on his back, the working machine is required to be once dismounted from his back, which action is quite inconvenient for the operator.

Whereas, when a D.C.-motor type starter is employed as a starter, the internal combustion engine can be easily started while carrying the working machine on the operator's back. In that case however, the total weight of the working machine would be considerably increased due to the D.C.-motor and the battery as a power source for the D.C.-motor, and at the same time, the structure of the starter would become complicated, thus increasing the manufacturing cost thereof.

Under the circumstances, there has been proposed a recoil starter which makes it possible to perform the starting operation of the internal combustion engine under the condition where the backpack-type power working machine is kept shouldered by the operator's back. For example, Japanese Utility Model Unexamined Publication S59-19975 discloses a recoil starter wherein the recoil rope is designed to be guided by a flexible guide pipe. Since this recoil starter is constructed such that the recoil handle thereof (recoil rope and one end of the guide pipe) is not supported at all, it is difficult to smoothly perform the rope-pulling operation. Moreover, since the recoil rope and the guide pipe end are allowed to hang loose during the working operation, there are problems that they may disturb the working operation or may be damaged as they are caught by the branch of a tree.

On the other hand, Japanese Utility Model Publication H2-48695 discloses a recoil starter wherein a base end portion of the guide pipe for guiding the recoil rope is supported by the main body of the starter, and a distal end portion of the guide pipe is secured to the shoulder contact portion of the shouldering band. According to this recoil starter, since the recoil handle (grip) is supported at the vicinity of a front portion of the shoulder (or a distal end portion of the guide pipe), the recoil handle can be prevented from being hung loose. However, there are problems that the face of the operator may be impinged against the recoil handle, and that the guide pipe may bend as it is caught by the branch of a tree, thus damaging the guide pipe, in particular, the base end portion thereof.

BRIEF SUMMARY OF THE INVENTION

The present invention has been made in view of overcoming the aforementioned problems accompanied with the conventional starters, and therefore, it is an object of the present invention to provide a starter for a backpack-type power working machine, which is capable of easily performing the starting operation of an internal combustion engine under the condition where the working machine is kept carried on the operator's back, which can be manufactured lighter in weight and cheaper in manufacturing cost, which is relatively free from trouble, and which can hardly be damaged even if a portion of the starter is caught by the branch of a tree.

With a view to attaining the aforementioned object, there is provided, in accordance with the present invention, a recoil starter for starting an internal combustion engine to be mounted on a backpack-type power working machine. The recoil starter comprises a recoil rope; a recoil handle which is attached to one end portion of said recoil rope, placed remote from the main body of the starter by a predetermined distance, and adapted to be supported by a handle-supporting member provided at a specific portion of said backpack-type power working machine; and a flexible guide pipe loosely sheathing an extended portion of said recoil rope which is located between said main body and said handle-supporting member, one end of said guide pipe being fixed, and the other end thereof being made free.

Preferably, said handle-supporting member is provided at a portion of the working machine, which approximately corresponds to the waist portion of the operator shouldering the working machine, thereby enabling the recoil handle to be pulled toward the front of the operator on the occasion of starting the internal combustion engine.

Preferably, said guide pipe is made of a synthetic resin, and one end of said guide pipe is press-inserted into a cylindrical portion provided at said handle-supporting member, thereby enabling said guide pipe to be detachably secured to the handle-supporting member. More preferably, an elastic ring member is externally fitted on one end portion of the guide pipe which is located close to the main body.

The recoil starter for a backpack-type power working machine according to the present invention, which is constructed as described above, is characterized in that the recoil handle is placed remote from the main body of the starter by a predetermined distance and supported by the handle-supporting member provided at a specific portion of the backpack-type power working machine (for example, a portion corresponding to a right waist portion of the operator), that the recoil handle is designed to be pulled toward the front of the operator, that a flexible guide pipe is provided so as to loosely sheath an extended portion of the recoil rope which is located between the main body and the handle-supporting member, and that one end of the guide pipe is fixed and the other end thereof is made free. Therefore, the starting operation of the engine can be easily performed even under the condition where the working machine is kept shouldered by the operator. Additionally, since this recoil starter for a backpack-type power working machine according to the present invention is the same in structure as the conventional recoil starter for a backpack-type power working machine except that only the handle-supporting member and the flexible guide pipe are additionally provided, the recoil starter can be made lighter in weight and lower in manufacturing cost as compared with a D.C.-motor type recoil starter.

Further, since the recoil starter according to the present invention is simple in structure, it is possible to minimize the breakdown thereof. Additionally, even if the flexible guide pipe is caught by the branch of a tree, the guide pipe can be bent in the direction pulled by the branch of the tree, and at the same time, the recoil rope is permitted to be drawn out of the main body of the starter (from the reel thereof), thus enabling the free end side of the recoil rope to move in the direction pulled by the branch of the tree, so that the fixed end portion of the guide pipe can be prevented from being imposed by a large magnitude of load, and therefore can be inhibited from being damaged.

On the other hand, since the recoil starter for a backpack-type power working machine of the present invention is designed such that the engine-starting operation is performed while shouldering the working machine, it is preferable to employ a recoil starter which enables the start-up of the engine to be performed with a relatively small magnitude of rope-pulling force as compared with a recoil starter where the rope-pulling operation is performed after dismounting the working machine.

As for the recoil starter which enables the start-up of the engine to be performed with a relatively small magnitude of rope-pulling force, a power-accumulating type recoil starter has been previously proposed by the present inventors. This power-accumulating type recoil starter comprises a driving member which can be rotated by the pulling of the recoil rope, a driven member to which the rotation of the driving member is designed to be transmitted, and a buffering/power-accumulating means which is disposed between the driving member and the driven member, wherein the buffering/power-accumulating means is enabled, during the driving process by the driving member, to accumulate the power supplied through the driving process while alleviating any shock to the driven member, the accumulated power being subsequently employed to drive the driven member (for more details, see Japanese Patent Unexamined Publication 2001-132591, and its U.S. patent application equivalent, Ser. No. 09/639,561, which are incorporated herein by reference).

According to this power-accumulating type recoil starter, since the buffering/power-accumulating means (a spiral spring mechanism) is interposed between the driving member and the driven member, it is possible to derive a buffering effect from the spiral spring mechanism during the first-half driving process (until the piston of the internal combustion engine reaches the top dead center thereof) in the pulling operation of the recoil rope (recoiling operation), and at the same time, to enable the pulling force of the recoil rope to be accumulated in the spiral spring mechanism. During the latter-half driving process, the pulling force thus accumulated in the spiral spring mechanism during the first-half driving process is permitted to be combined with the pulling force to be actually effected in the latter-half pulling operation of the recoil rope to thereby generate a resultant force, which is utilized as a force for starting the internal combustion engine. As a result, it is possible to minimize a fluctuation in pulling force of rope so as to smooth the rope-pulling operation, and also to enable the engine to be easily started while the working machine is kept shouldered on the operator's back without requiring a large magnitude of pulling force.

DETAILED DESCRIPTION OF THE INVENTION

Next, one embodiment of the recoil starter according to the present invention will be explained with reference to the drawings.

Figure 1:
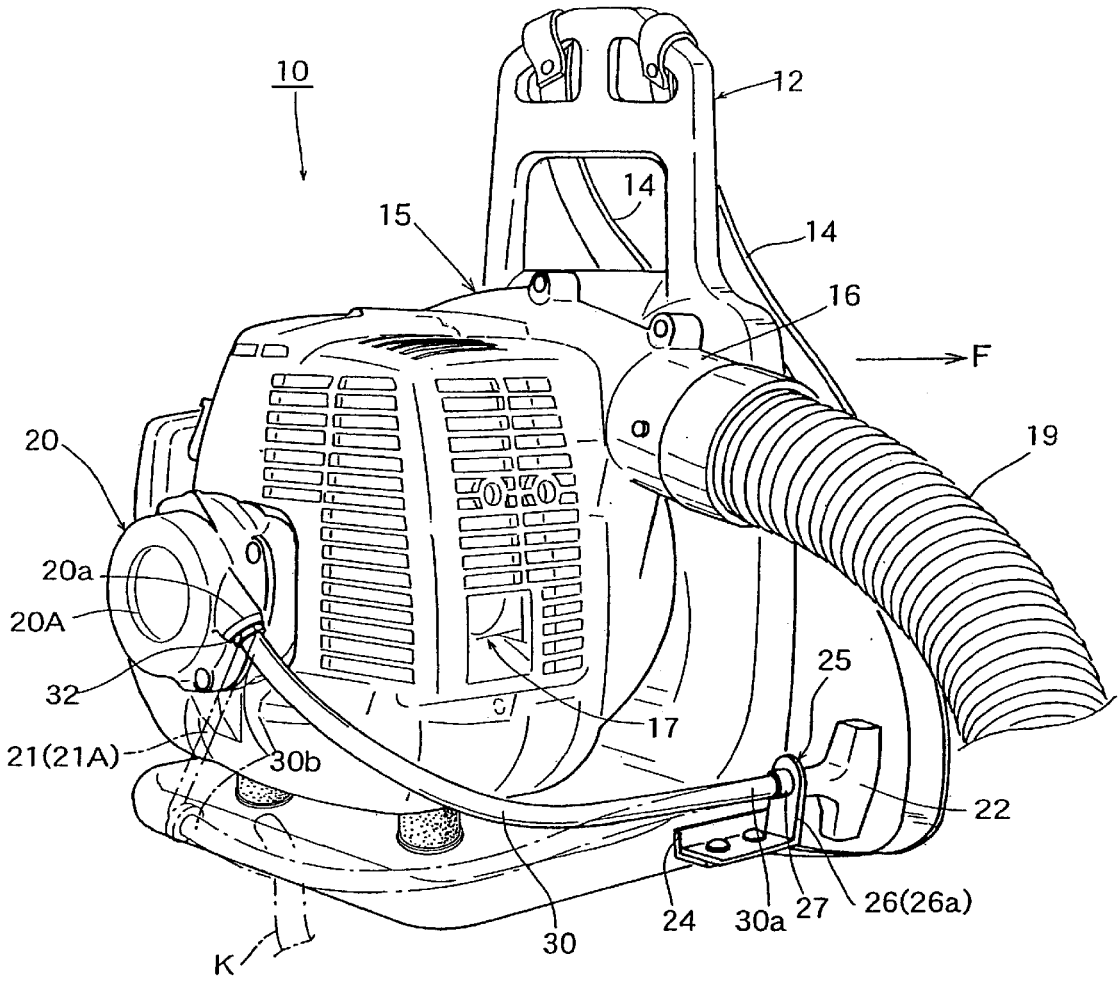
FIG. 1 is a perspective view of a recoil starter representing one embodiment of the present invention, which is shown together with a backpack-type power working machine as they are viewed from the right rear side thereof.

FIG. 1 shows a perspective view of a recoil starter representing one embodiment of the present invention, which is shown together with a backpack-type power working machine as they are viewed from the right rear side thereof. Referring to FIG. 1, the backpack-type power working machine 10 is a so-called power blower (air blower-type cleaner) which is employed for collecting fallen leaves or refuse by making use of an accelerated and compressed air blow instead of using a broom or rake. This power working machine 10 comprises an L-shaped (in side view) backpack frame 12 having a pair of shouldering bands 14, an air-cooled gasoline engine (internal combustion engine) 17 functioning as a power source and mounted on the L-shaped backpack frame 12, and an air blower 15 which is directly connected to the gasoline engine 17 and mounted on the L-shaped backpack frame 12.

The air blower 15 is designed such that external air is inhaled therein so as to be accelerated and compressed, and the resultant compressed air is then exhaled therefrom through an exhaust nozzle 16 which is horizontally placed on the right side of the working machine 10 and is finally ejected to the external atmosphere through a bellows-like flexible tube 19 and an injection pipe (not shown).

The recoil starter 20 according to this embodiment is coupled with the outer end portion (rear end portion) of the crank shaft (not shown) of the internal combustion engine 17, which is arranged so as to lie on the same axial line of the rotation axis (not shown) of the air blower 15.

The recoil starter 20 according to this embodiment is of a power-accumulating type, and it comprises a driving member including a spiral spring functioning as a recoil-urging means for reversely rotating the rope reel so as to automatically wind up the recoil rope 21, a driven member to which the rotation of the driving member is transmitted, and a spiral spring mechanism functioning as a buffering/power-accumulating means which is disposed between the driving member and the driven member, wherein the buffering/power-accumulating means is enabled, during the driving process by the driving member, to accumulate the power supplied through the driving process by the driving member while alleviating any shock to the driven member, the accumulated power being subsequently employed to drive the driven member.

Figure 2:
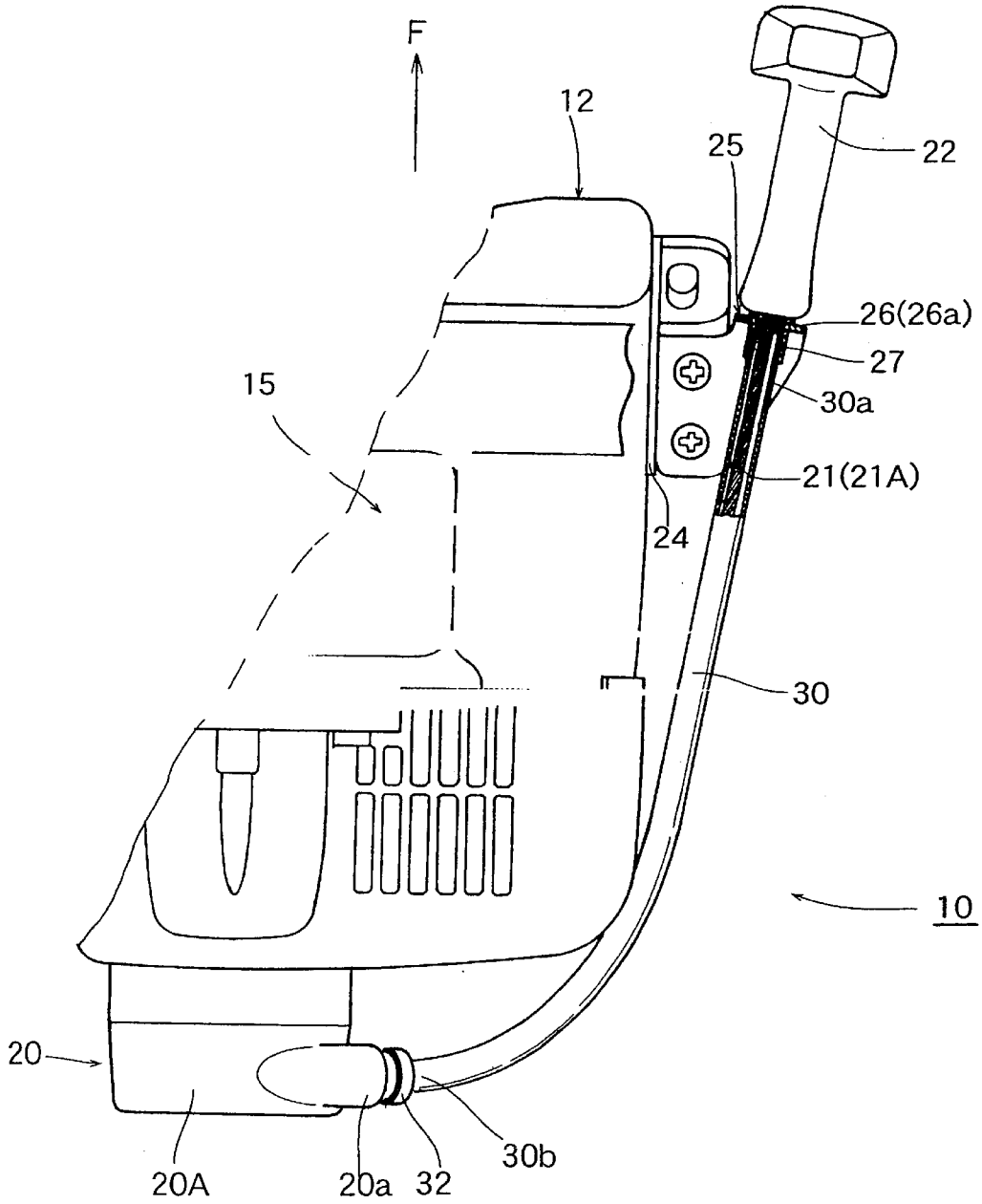
FIG. 2 is an enlarged partial plan view of the starter shown in FIG. 1.
Figure 3:
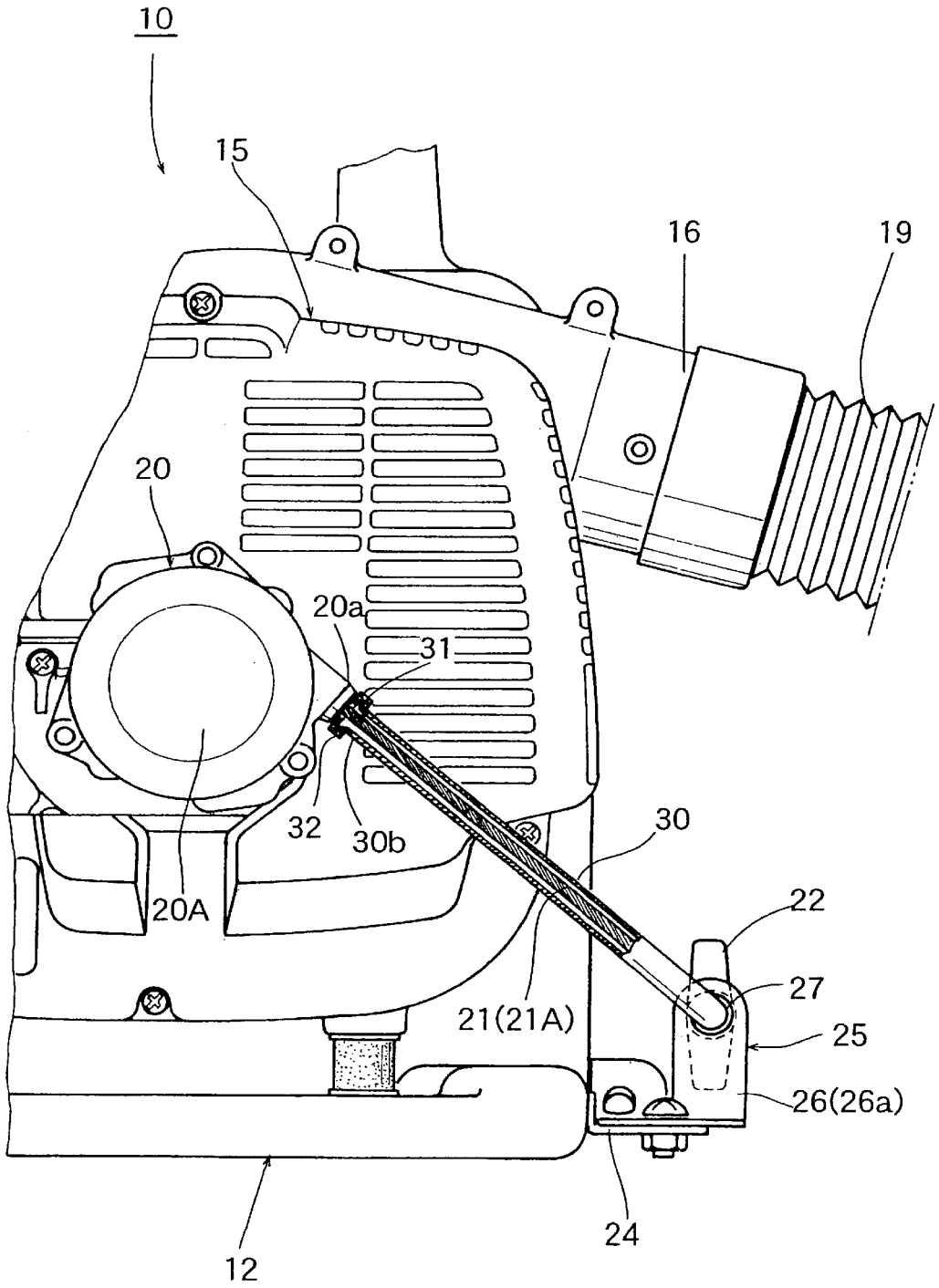
FIG. 3 is an enlarged partial underside view of the starter shown in FIG. 1.

As shown in FIGS. 1, 2 and 3, the recoil handle 22 that has been attached to one end portion of the recoil rope 21 is placed remote from the outlet port 20*a* of the main body 20A of the starter by a predetermined distance and supported by the handle-supporting member 25 provided at a specific portion of the backpack-type power working machine which approximately corresponds to a right waist portion of the operator shouldering the working machine 10, and moreover, an extended portion 21A of the recoil rope 21 which is located between the main body 20A and the handle-supporting member 25 is loosely sheathed by a flexible guide pipe 30 which is made of a synthetic resin such as nylon. In this case, one end portion 30*a* of the guide pipe 30 located closer to the handle-supporting member 25 is fixed, while the other end portion 30*b* thereof located closer to the main body 20A is made free to move, and the recoil handle 22 is designed to be pulled out toward the front F of the operator on the occasion of starting the internal combustion engine 17.

Figure 4:
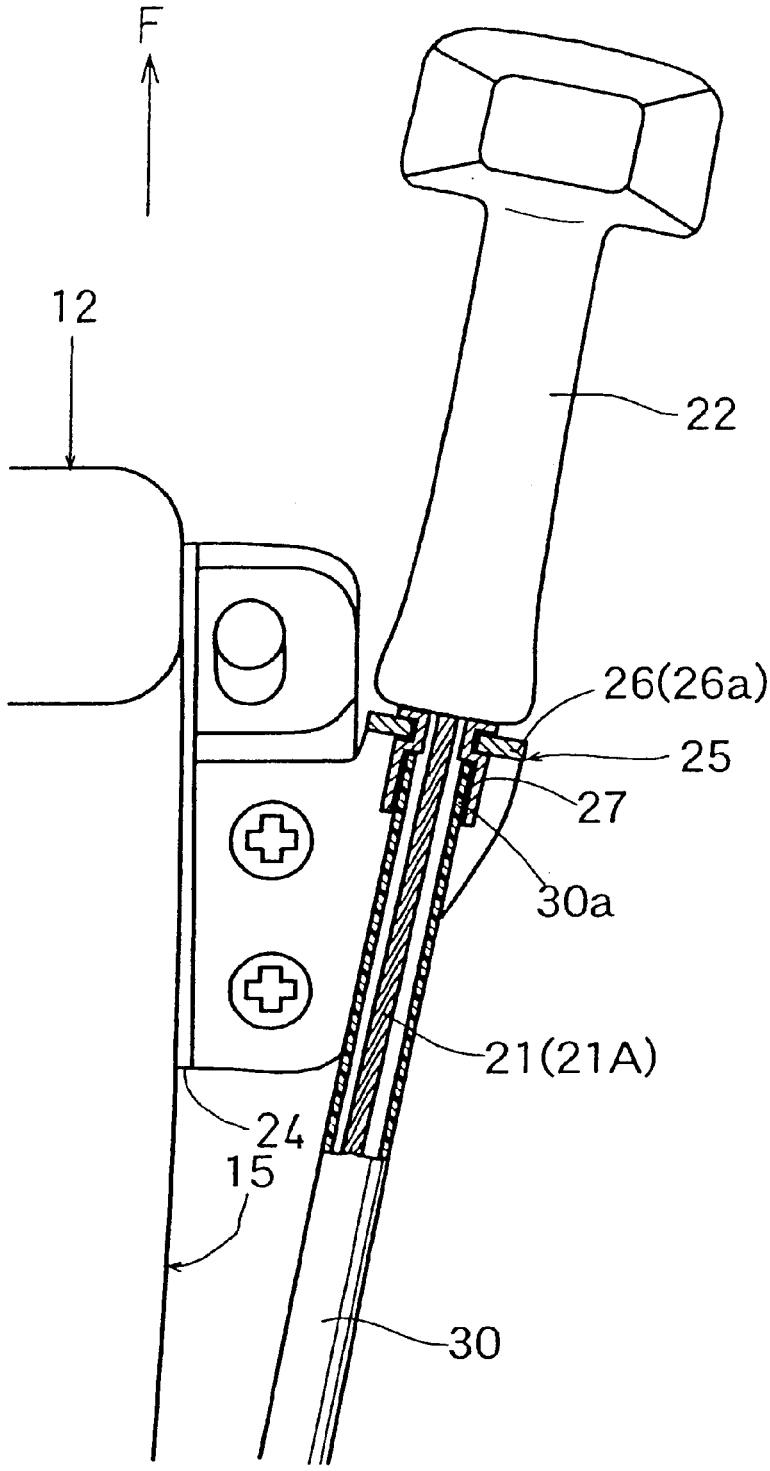
FIG. 4 is an enlarged partially sectioned plan view of the region around the handle-supporting member of the starter shown in FIG. 2.

More specifically, as shown in FIG. 4, the handle-supporting member 25 is provided with an L-shaped plate 26 which is screwed to a bracket 24 fixed to the right lower end portion of the shouldering frame 12, and the recoil rope 21 is pierced through a ring member 27 secured to the upright portion 26*a* of the L-shaped plate 26. Furthermore, the one end portion 30*a* of the guide pipe 30 is detachably press-inserted into the ring member 27 and secured thereto.

Figure 5:
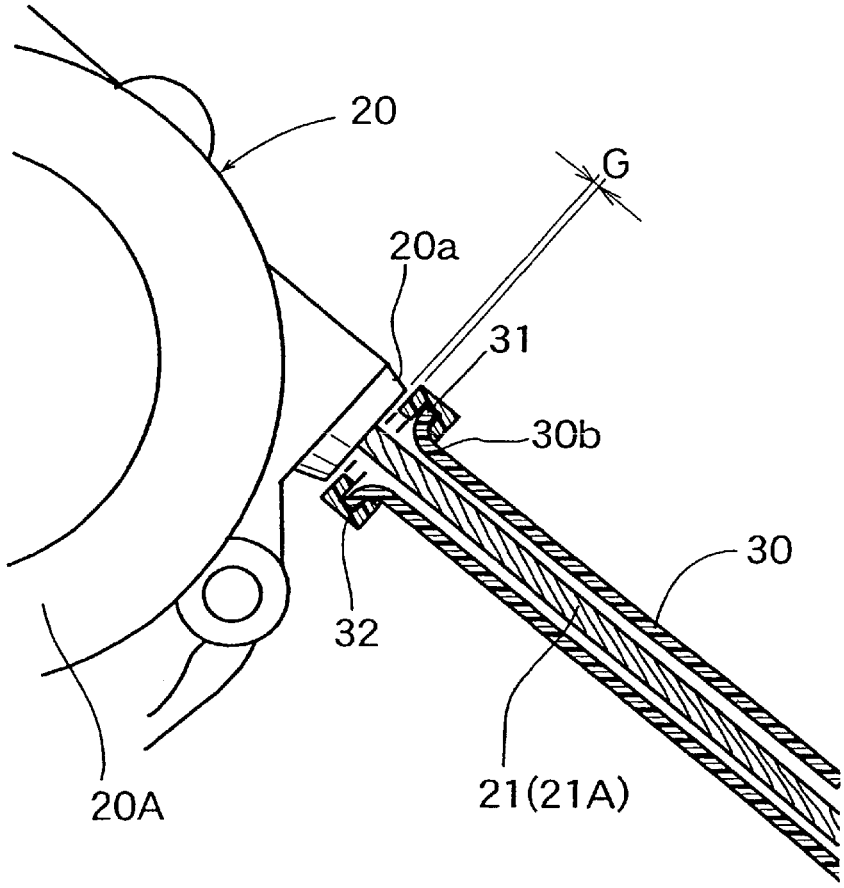
FIG. 5 is an enlarged partially sectioned underside view of one end portion of the guide pipe which is located close to the main body of the starter shown in FIG. 3.

As shown in FIG. 5, the other end portion 30*b* of the guide pipe 30 (the end portion located close to the main body 20A) is shaped into a flange 31 on which an elastic ring member 32 made of rubber for instance is externally fitted, thus enabling it to serve as a buffering/protecting member. Note that a slight gap G is formed between the other end portion 30*b* of the guide pipe 30 (the elastic ring member 32) and the outlet port 20*a* of the main body 20A.

According to the recoil starter 20 for a backpack-type power working machine, which is constructed according to this embodiment, since the recoil starter 20 is constructed in such a manner that the recoil handle 22 is placed remote from the main body 20A of the starter by a predetermined distance and supported by the handle-supporting member 25 provided at a specific portion of the working machine 10 corresponding to a right waist portion of the operator, that an extended portion 21A of the recoil rope 21 which is located between the main body 20A and the handle-supporting member 25 is loosely sheathed by a flexible guide pipe 30, that one end 30*a* of the guide pipe 30 is fixed, while the other end 30*b* thereof is made free, and that the recoil handle 22 is designed to be pulled out toward the front F of the operator on the occasion of starting the internal combustion engine 17, the starting operation of the engine can be easily performed under the condition where the working machine 10 is kept shouldered by the operator. Additionally, since this recoil starter 20 for a backpack-type power working machine according to this embodiment is simple and the same in structure as the conventional recoil starter for a backpack-type power working machine except that only the handle-supporting member 25 and the flexible guide pipe 30 are additionally provided, the recoil starter can be made lighter in weight and lower in manufacturing cost as compared with a D.C.-motor type recoil starter.

Additionally, since the recoil starter according to this embodiment is simple in structure, it is possible to minimize the breakdown thereof. Moreover, even if the flexible guide pipe 30 is caught by the branch of a tree K, the guide pipe 30 can be bent in the direction pulled by the branch of the tree K, and at the same time, the recoil rope 21 is permitted to be drawn out of the main body 20A of the starter (from the reel thereof), thus enabling the free end side 30*b* of the recoil rope 21 to move in the direction pulled by the branch of the tree K, so that the fixed end portion 30*a* of the guide pipe 30 can be prevented from being imposed by a large magnitude of load, and hence, can be inhibited from being damaged.

While in the foregoing one embodiment of the present invention has been explained, it will be understood that the construction of the device can be varied without departing from the spirit and scope of the invention.

As clearly understood from the above explanation, the recoil starter for a backpack-type power working machine according to the present invention is advantageous in that it is capable of easily performing the starting operation of an internal combustion engine under the condition where the working machine is kept shouldered by the operator's back, that it can be manufactured lighter in weight and cheaper in manufacturing cost, that it is relatively free from trouble, and that is not easily damaged even if a portion of the starter is caught by the branch of a tree.

What is claimed is:

1. A recoil starter for starting an internal combustion engine to be mounted on a backpack-type power working machine, the recoil starter comprising:

a main body;

a recoil rope extending from the main body;

a recoil handle attached to an end portion of the recoil rope, placed remote from the main body of the starter by a predetermined distance, and adapted to be supported by a handle-supporting member provided at a specific portion of the shoulder-type power working machine; and a flexible guide pipe loosely sheathing an extended portion of the recoil rope located between the main body and the handle-supporting member, a first end of the guide pipe being fixed and a second end of the guide pipe being free;

wherein the handle-supporting member is provided at a portion of the working machine approximately corresponding to the waist portion of an operator shouldering the working machine, thereby enabling the recoil handle to be pulled toward the front of the operator on the occasion of starting the internal combustion engine.

2. The recoil starter according to claim 1, wherein the guide pipe is made of a synthetic resin.

3. The recoil starter according to claim 2, wherein an elastic ring member is externally fitted on the second end portion of the guide pipe located close to the main body.

4. The recoil starter according to claim 1, wherein an elastic ring member is externally fitted on the second end portion of the guide pipe located close to the main body.

5. A shoulder-type power working machine comprising:

a backpack frame;

a power source mounted on the backpack frame;

a blower connected to the power source and mounted on the backpack frame;

a recoil starter coupled to the power source; and a handle-supporting member coupled to the backpack frame;

the recoil starter further comprising:

a main body;

a recoil rope extending from the main body;

a recoil handle attached to an end portion of the recoil rope, placed remote from the main body of the starter by a predetermined distance, and adapted to be supported by the handle-supporting member provided at a specific portion of the backpack-type power working machine; and a flexible guide pipe loosely sheathing an extended portion of the recoil rope located between the main body and the handle-supporting member, a first end of the guide pipe being fixed and a second end of the guide pipe being free;

wherein the handle-supporting member is provided at a portion of the working machine approximately corresponding to the waist portion of an operator shouldering the working machine, thereby enabling the recoil handle to be pulled toward the front of the operator on the occasion of starting the internal combustion engine.

6. The backpack-type power working machine according to claim 5, wherein the guide pipe is made of a synthetic resin.

7. The backpack-type power working machine according to claim 6, wherein an elastic ring member is externally fitted on the second end portion of the guide pipe located close to the main body.

8. The backpack-type power working machine according to claim 5, wherein the guide pipe is made of a synthetic resin.

9. The backpack-type power working machine according to claim 8, wherein an elastic ring member is externally fitted on the second end portion of the guide pipe located close to the main body.

10. A shoulder-type power working machine comprising:

a backpack frame;

a power source mounted on the backpack frame;

a blower connected to the power source and mounted on the backpack frame;

a recoil starter coupled to the power source; and a handle-supporting member coupled to the backpack frame;

the recoil starter further comprising:

a main body;

a recoil rope extending from the main body;

a recoil handle attached to an end portion of the recoil rope, placed remote from the main body of the starter by a predetermined distance, and adapted to be supported by the handle-supporting member provided at a specific portion of the backpack-type power working machine; and a flexible guide pipe loosely sheathing an extended portion of the recoil rope located between the main body and the handle-supporting member, a first end of the guide pipe being fixed and a second end of the guide pipe being free;

wherein an elastic ring member is externally fitted on the second end portion of the guide pipe located close to the main body.

11. The backpack-type power working machine according to claim 5, wherein an elastic ring member is externally fitted on the second end portion of the guide pipe located close to the main body.

12. The backpack-type power working machine according to claim 10, wherein the guide pipe is made of synthetic resin.

* * * * *